US006128392A

United States Patent [19]

Leysieffer et al.

[11] Patent Number: 6,128,392

[45] Date of Patent: Oct. 3, 2000

[54] HEARING AID WITH COMPENSATION OF ACOUSTIC AND/OR MECHANICAL FEEDBACK

[75] Inventors: Hans Leysieffer, Taufkirchen; Hans Delfs, Stockdorf, both of Germany

[73] Assignee: Implex Aktiengesellschaft Hearing Technology, Ismaning, Germany

[21] Appl. No.: 09/090,228

[22] Filed: Jun. 4, 1998

[30] Foreign Application Priority Data

Jan. 23, 1998 [DE] Germany ..... 198 02 568

[51] Int. Cl.[7] ..... H04R 25/00

[52] U.S. Cl. ..... 381/318; 381/314

[58] Field of Search ..... 381/314, 318, 381/312, 320, 321, 96

[56] References Cited

U.S. PATENT DOCUMENTS

| | | | |
|---|---|---|---|
| 5,111,419 | 5/1992 | Morley, Jr. et al. | 381/314 |
| 5,259,033 | 11/1993 | Goodings et al. | 381/318 |
| 5,475,759 | 12/1995 | Engebretson | 381/318 |
| 5,621,802 | 4/1997 | Harjani et al. | 381/314 |

FOREIGN PATENT DOCUMENTS 0 415 677 3/1991 European Pat. Off. .

OTHER PUBLICATIONS

Roland Best, Digitale Filter, Handbook of Analog and Digital Filtering Engineering, pp. 97–113.

DFS–EIN Neues Digitales System Zur Rückkopplungsunterdrückung in Hörgeräten, Rückkopplungs–Unterdrückung, Nikolai Bisgaard, Ole Dyrlund, Audiologische Akustik, May 1991, pp. 166–175.

*Primary Examiner*—Curtis A. Kuntz
*Assistant Examiner*—P. Dabney
*Attorney, Agent, or Firm*—Nixon Peabody LLP; David S. Safran

[57] ABSTRACT

A hearing aid has a microphone (1), or other electromechanical transducer, for converting an acoustic input signal into an electrical signal, a signal-processing and amplifying signal path (2, 3, 13, 4, 5, 6) and an output converter (7) which converts the amplified electrical signals back into acoustic signals, or in the case of an implanted hearing aid into mechanical signals, and a feedback digital finite impulse response filter (FIR filter) (9) for compensation of unwanted feedback (8) from the output converter to the microphone, in which the filter coefficients of filter (9) are determined by feeding a short pulse into the feedback signal path (5, 6, 7, 1, 2) and directly measuring the impulse response of this signal path.

19 Claims, 4 Drawing Sheets

HEARING AID WITH COMPENSATION OF ACOUSTIC AND/OR MECHANICAL FEEDBACK

BACKGROUND OF THE INVENTION

1. Field of the Invention

The invention relates to a hearing aid in which acoustic and/or mechanical feedback of the signal is compensated by an internal signal path. In particular, the invention relates to a hearing aid in which the signal path contains, in succession, a microphone, an A/D converter for conversion of the microphone output signal into a sequence of discrete digital samples, a signal processing stage, a D/A converter for converting the processed digital signals back into analog form, an amplifier and an output converter, and which is furthermore provided with a feedback path within the hearing aid, in which a digital filter with a finite impulse response is located, with a transfer function which can be set by setting corresponding filter coefficients, and a determination and setting circuit which determines the transfer function of the feedback signal path via which unwanted acoustic and/or mechanical feedback between the output converter and the microphone takes place, and which adjusts the filter coefficients of the filter in the feedback path within the hearing aid depending on the determined transfer function of the feedback signal path, such that this filter compensates, at least partially, for the acoustic and/or mechanical feedback.

2. Description of Related Art

A hearing aid of the type to which this invention is directed is described in European Patent Application Publication No. 0 415 677 A2. The disclosed hearing aid is of the type conventionally worn behind or in the ear, and with which the output signal reaches the wearer acoustically.

Most of the properties of the hearing aid described in patent application 0 415 677 can be applied by one skilled in the art to the case of a fully or partially implanted hearing aid, but there are also characteristic differences to which reference is made separately in this description. In particular, for implanted hearing aids, the user does not receive the output signal acoustically through the air, but it is generally coupled by an electromechanical converter to one of the auditory ossicles. Hereinafter, when the output converter of the hearing aid is addressed, it is always assumed that depending on the application it can be both an electroacoustical and also an electromechanical converter.

In the simplest case, as shown in FIG. 2, a hearing aid is comprised of a microphone 1 which receives an acoustic input signal ea(t) and converts it into an electrical signal e(t), a filter 4 which processes the signal e(t), such as is necessary for the special hearing damage of the wearer, and delivers an output signal a(t), an amplifier 6 which produces an amplified output signal av(t) therefrom, and an output converter 7. The letters (t) indicate that the signals are analog signals in the continuous time domain.

This principle is preserved if the signal path in the hearing aid is subjected to digital signal processing, as is shown in FIG. 3, in which case an analog/digital converter 2, which converts electrical output signal e(t) of microphone 1 into a sequence of discrete digital samples e(m), is added to the block diagram. The A/D converter 2 is followed by a digital filter 4 with a mode of operation which can be ignored here, in which samples e(m) are processed such as is necessary for the special hearing damage of the wearer. The letter (m) indicates that the signals are digital signals in a discrete time interval. This is followed by conversion of the filtered digital signals a(m) back into analog form using a digital/analog converter 5, after which, as before, follow amplifier 6 and converter 7. Otherwise it is essentially irrelevant whether D/A converter 5 and amplifier 6 are in fact separate units, or whether they are inseparably interconnected in a single unit.

Unfortunately, in practice, it usually cannot be avoided that the output signal aa(t) couples back to the microphone and that, therefore, a feedback signal r(t) is added to the acoustic input signal which is formed from signal aa(t) by the time behavior h(t) of feedback section 8. This yields the block diagram in FIG. 4.

In a conventional hearing aid, the feedback path leads through the air to the microphone, while in an implanted hearing aid there are different propagation paths, for example, via the bones and other parts of the skull, or on a path via the eardrum and air.

In such closed signal loops, it fundamentally applies that the signal becomes unstable as soon as the loop gain exceeds 1. But, before this limit is reached, at the frequencies at which the loop gain approaches 1, resonant phenomena occur which are unpleasant for the user of the hearing aid. Therefore, the loop gain should always remain essentially less than 1. However, this conflicts with the fact that, depending on the severity of the hearing damage of the wearer, under certain circumstances very high gains are necessary.

Not shown in the diagrams in FIGS. 2 and 3, however generally representing the prior art, there is digital system control which normally can be accessed via a remote control and which allows the properties of the hearing aid to be controlled, for example, the properties of filter 4 or amplifier 6. Moreover, in the operation of the hearing aid, the system control assumes control and monitoring functions in and between the individual modules.

It is prior art to at least partially compensate feedback according to FIG. 1 by internal feedback filter 9 in the hearing aid. This filter leads back from the input of D/A converter 5 to a summation point 3 at the output of A/D converter 2. So that undesired feedback is optimally compensated, filter 9 must, as accurately as possible, have the same signal behavior as the signal path 5, 6, 7, 8, 1 , 2, but with the opposite sign. Then, from digital signal a(m) on the path 5, 6, 7, 8, 1, 2 and on the path via 9, two oppositely identical digital signals form which cancel one another at the summation point 3. Thus, there remains only one digital signal which, in the ideal case, is exactly the digital representation e(m) of the acoustic input signal ea(t).

Thus, the problem exists of determining the transfer properties of filter 9 such that it has the same impulse response as the signal path 5, 6, 7, 8, 1, 2, but with the opposite sign.

This problem was solved, for example, according to European Patent Application No. 0 415 677 by a digital pseudo-noise signal being supplied at the output of digital filter 4. This noise signal travels both through the signal path 5, 6, 7, 8, 1, 2 and also through the filter 9. With optimum compensation, it would have to be exactly compensated at the summation point 3. To do this, the original digital noise signal is supplied to one input of a digital correlator while the output signal of the summation element 3 is supplied to the other input. The individual delay stages of the correlator deliver digital values which are used for adaptive optimization of the coefficient of the filter 9.

This process causes continuous matching of the filter to the conditions of feedback path 8 which are highly variable in time in conventional hearing aids. For example, shifting the hearing aid to behind the ear or approaching a soundreflecting article can cause a significant change of the feedback path. The disadvantage of this process is a comparatively high cost in digital processing. Thus, for example, for one coefficient multiplication in the FIR digital filter at least two more multiplications with variable factors are required for filter adaptation.

SUMMARY OF THE INVENTION

In view of the foregoing, the present invention has as a primary object to find an especially simple way of determining the filter coefficient of a FIR digital filter used as compensation filter, particularly for entirely or partially implanted hearing aids, also for conventional hearing aids.

This object is achieved in accordance with preferred embodiments of the invention by providing the determination and setting circuit with a pulse generator for feeding short individual pulses to the feedback signal path 2 and using the impulse response of the feedback signal path which is triggered by the individual pulses to measure the transfer function of the path, the duration of the individual pulses being at most equal to 1/f, where f is the sampling frequency of the A/D converter and D/A converter.

DETAILED DESCRIPTION OF THE PREFERRED EMBODIMENT

Figure 1:
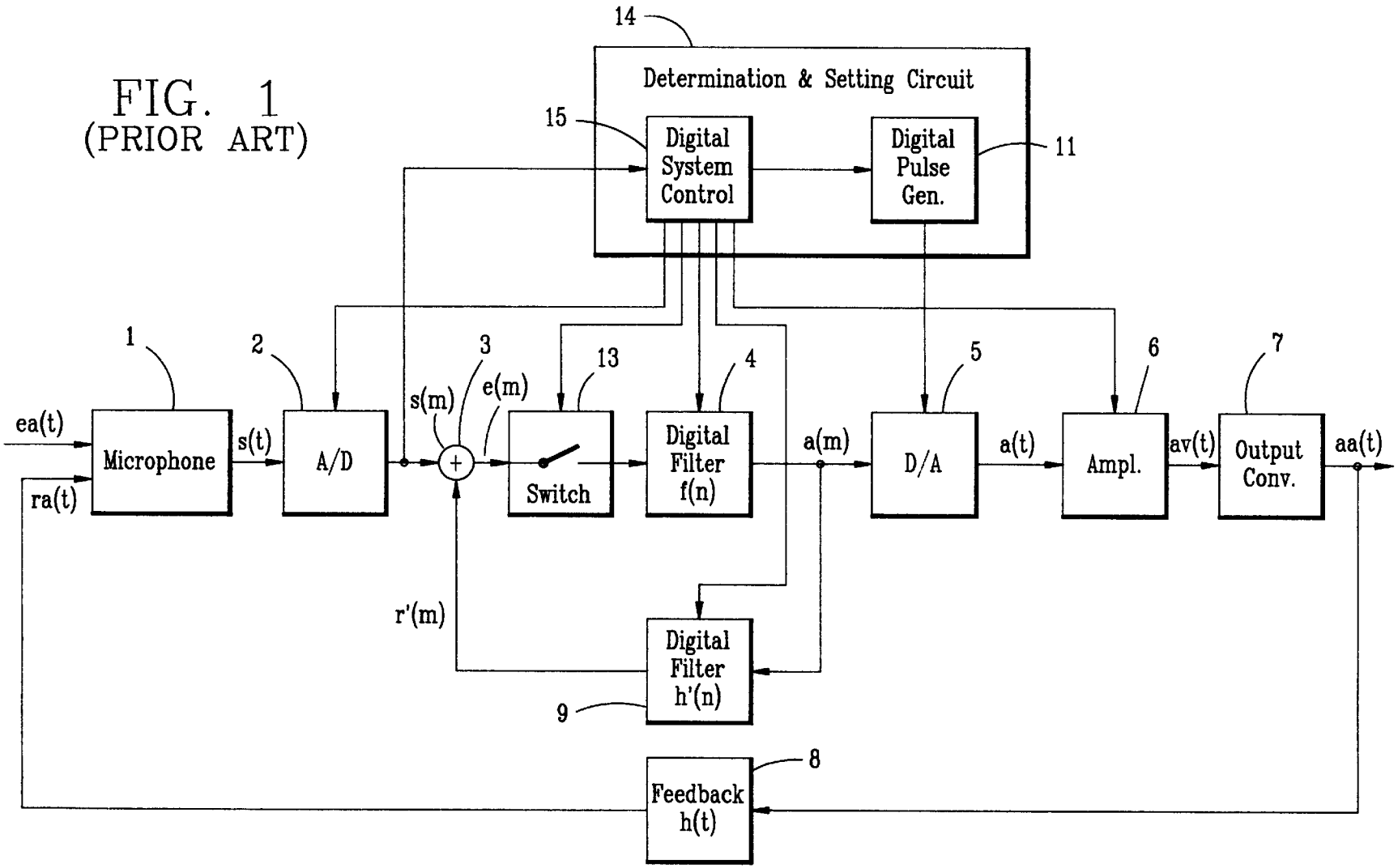
FIG. 1 (PRIOR ART)
FIGS. 1–4 are schematic circuit diagrams for describing the operation of prior art hearing aids.
Figure 2:
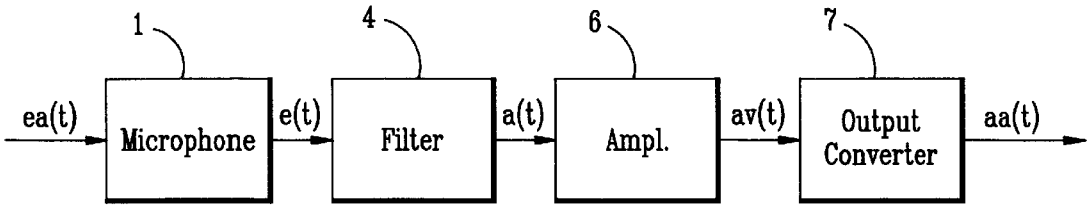
FIG. 2 (PRIOR ART)
Figure 3:
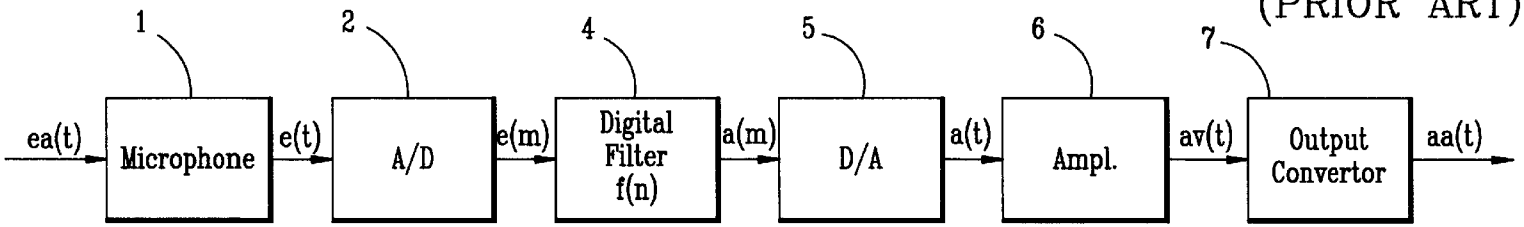
FIG. 3 (PRIOR ART)
Figure 4:
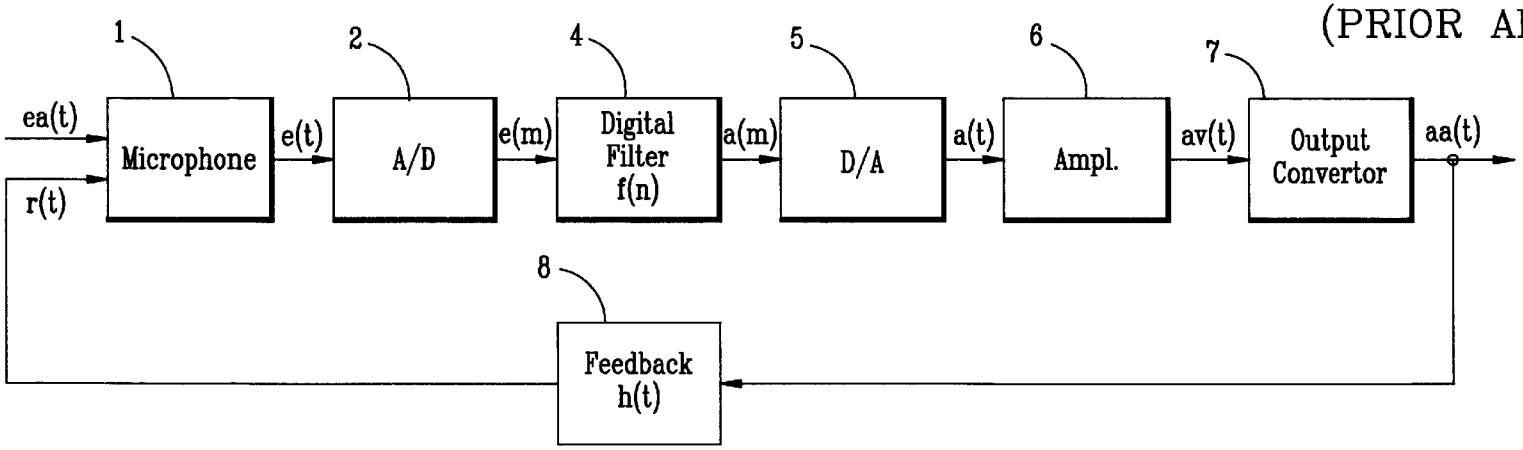
FIG. 4 (PRIOR ART)

In the following description, those components which correspond to elements of the prior art described above bear the same reference numeral, thereby facilitating comparison of the invention with the prior art, and highlighting the differences therebetween.

It is known from signal theory that both the frequency behavior and time behavior of a signal path can be completely described by its impulse response. In analog systems, the impulse response of a system is the time behavior of the system output as a reaction to an "infinitely short" impulse at the system input. The impulse response and frequency response are clearly linked to one another by a Fourier transform.

In reality there are no infinitely short impulses. In impulses of finite length, the impulse length determines the highest frequency up to which the impulse response correctly describes the system frequency response. In the case described here, we are dealing with a time-discrete system in feedback signal path 5, 6, 7, 8, 1, 2 , i.e. the input and output signals are known only at discrete times which differ by an integral multiple of a sampling time interval. In these signals, a signal which is different from zero only during one sampling period takes the place of the infinitely short pulse. This is the shortest pulse possible in a sampled system. The uppermost frequency boundary of a sampled system is linked with the duration of the sampling period T by the Nyquist sampling theorem, specifically, $f_{bound}=1/(2T)$ or $f_{bound}=f_s/2$, where $f_s$ is the sampling frequency. In practice, the sampling frequency is always chosen to be much higher than twice the highest relevant signal frequency.

If we examine signal path 5, 6, 7, 8, 1, 2 and a signal is supplied at time $t_0$ to its input which has amplitude 1 only during one sampling period, at the output of the signal path, a series of samples is observed as a reaction to this signal. These samples can be different from zero only for the times when $t>t_0$, because otherwise the reaction would occur before the cause. Therefore, at the output, i.e. at the A/D converter, a sequence of samples is obtained which have quantities $h_0, h_1, h_2 \ldots$ at times $t_0, t_0+T, t_0+2T \ldots$ Generally, the sequence of output samples is infinitely long.

It is assumed that signal path 5, 6, 7, 8, 1, 2 has an essentially linear signal behavior; this can be ensured, if necessary, by construction or circuit measures. Then, output signal $r_n$ of this path for any input signal which is given by the sequence $a_0, a_1, a_2, \ldots$ is the linear summation of reactions to all individual samples $a_n$ of the past. The following applies:

$$r(t_0+nT)=a(t_0+nT)h_0+a(t_0+(n-1)T)h_1+a(t_0+(n-2)T)h_2$$

or $$r_n = \sum_{k=0}^{\infty} a_{(n-k)} h_k$$

Signal $r_n$ thus arises by the convolution of signal a with the impulse response h. To exactly compensate this signal with the parallel compensation filter 9, the following would have to apply to this filter:

$$r'_n = \sum_{k=0}^{\infty} a_{(n-k)} h'_k = -\sum_{k=0}^{\infty} a_{(n-k)} h_k$$

Then the addition of the feedback signal and of the compensation signal in summation element 3 results in a zero signal.

The required transfer behavior can be achieved with a FIR digital filter with a good approximation. The theory of FIR filters, often called transversal filters, is presented in simple form in Roland Best, *Handbook of Analog and Digital Filtering Engineering,* pp. 97–113.

A FIR filter has the transfer function:

$$y_n = \sum_{k=0}^{N} x_{(n-k)} c_k$$

in which $y_n$ are the output samples, $x_n$ are the input samples and $c_k$ are the filter coefficients. Output signal y therefore arises by the convolution of the input signal x with the sequence of coefficients c. If we choose as filter coefficients $c_k$, the values $-h_k$, then the transfer function of the filter differs from the required one only by the finite length of the sum. However, since the reactions $h_k$ of the real signal path 5, 6, 7, 8, 1, 2 after a finite time decay to arbitrarily small values, it is possible to truncate the sequence of the $h_k$ after a finite number N without the finite sum differing significantly from the theoretically infinitely long one.

Filter 9 has output signal:

$$r'_n = \sum_{k=0}^{\infty} a_{(n-k)} h'_k = -\sum_{k=0}^{\infty} a_{(n-k)} h_k$$

and after adder 3, then the following arises as the signal:

$$r''_n = \sum_{k=0}^{\infty} a_{(n-k)} h_k + \sum_{k=0}^{N} a_{(n-k)} h'_k = \sum_{k=N+1}^{\infty} a_{(n-k)} h_k \approx 0$$

The remaining signal consists only of elements with k>N, which were assumed to be negligible.

Figure 5:
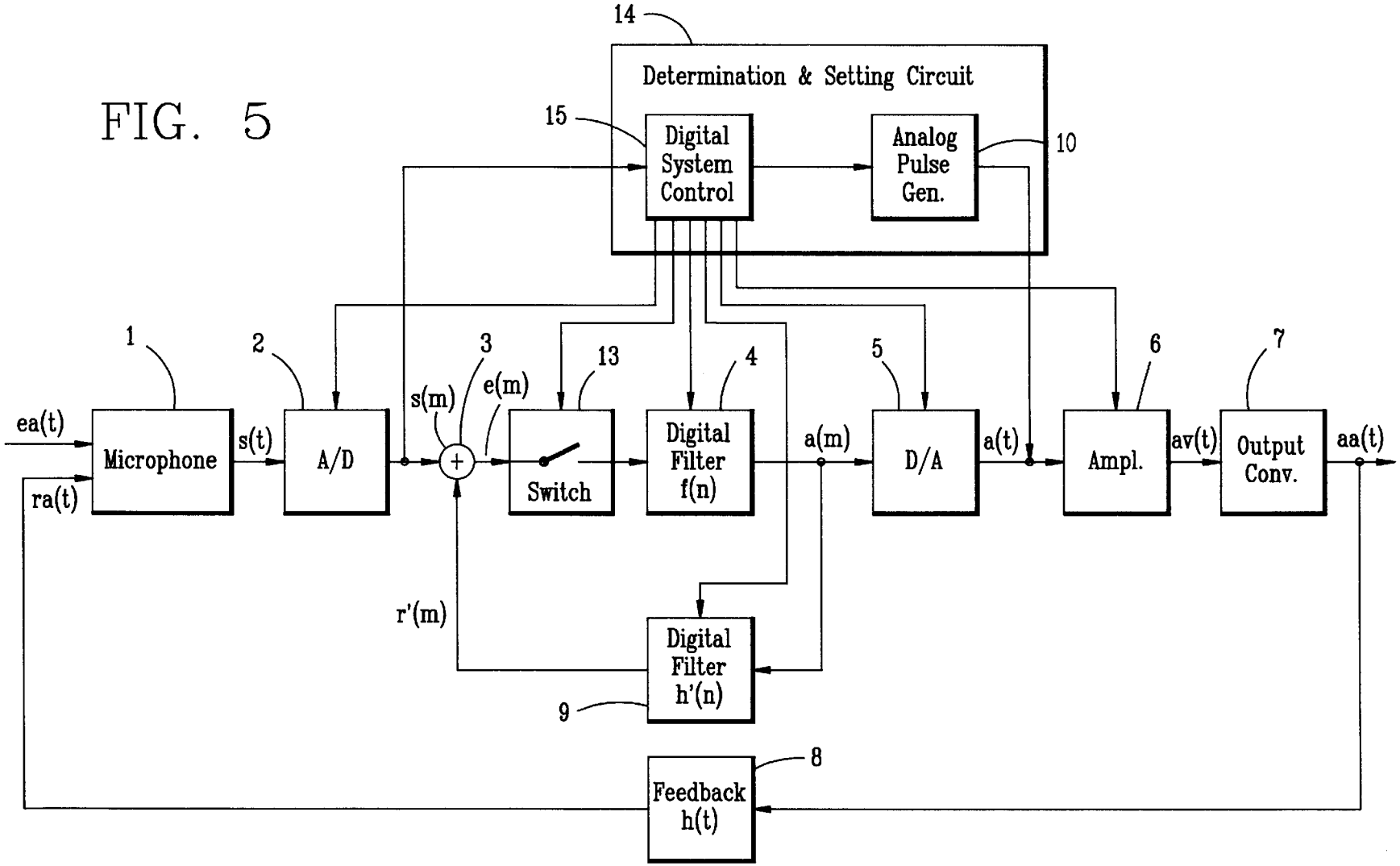
FIGS. 5 and 6 are a schematic diagrams of two embodiments of a hearing aid circuit in accordance with the present invention.

According to the aforementioned considerations, to determine the impulse response, a (digital) signal is fed to the D/A converter at the start of signal path 5, 6, 7, 8, 1, 2 which is not zero only during one sample period. Instead, a short analog pulse could also be supplied to amplifier 6. This pulse may then have, at most, the duration of one sampling period. The pertinent circuit diagram then corresponds to FIG. 5.

According to these theoretical principles, according to this invention, the determination of the filter coefficients of the FIR filter 9 is performed by the determination and setting circuit 14. This circuit contains means for generating very short pulses 10 or 11 and a digital system control 15. At the input of D/A converter 5, a short individual pulse is supplied which is produced by the digital pulse generator 11. Alternatively, at the input of amplifier 6 a short analog pulse is supplied. The A/D converter 2 registers the impulse response of signal path 5, 6,7, 8, 1 or 6, 7, 8, 1 at its input, assuming that, at this time, an external acoustic input signal does not act via the microphone and that the signal path is disconnected via filter 4 during measurement by switch 13. The A/D converter takes time samples from this impulse response at interval T. Based on the aforementioned, these samples (except for a common constant factor which takes into account the reversed sign and for analog impulses the integral content of the pulse) are exactly the coefficients with which the signal must be convoluted in the FIR filter so that the signal represents the time and frequency behavior of the signal path 6, 7, 8, 1. The digital system control 15 accepts the digital values of the samples from the A/D converter and sets the FIR filter to the coefficients determined therefrom.

Figure 6:
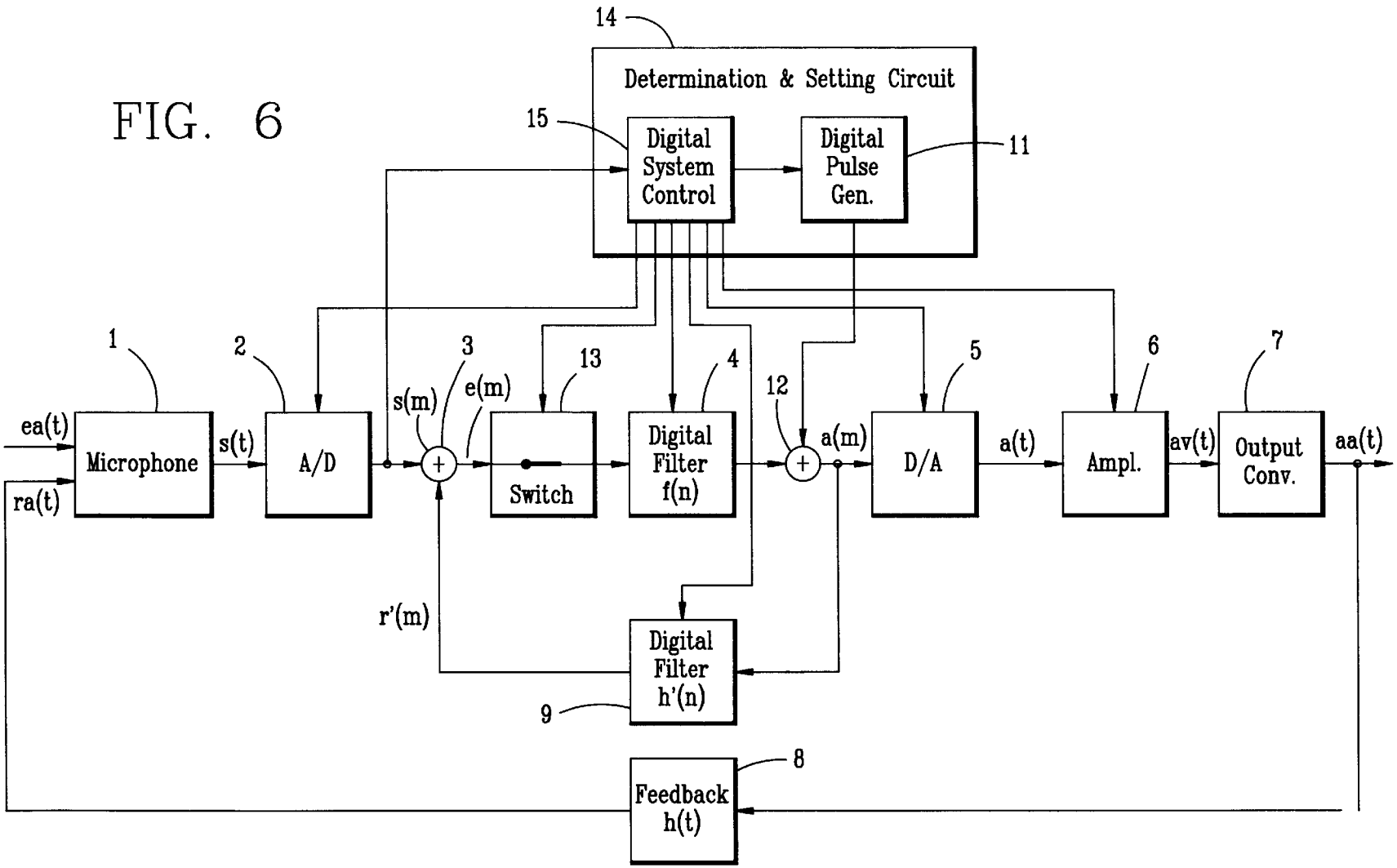

All the aforementioned strategies for application of the measurement process are used to calibrate from time to time the FIR filter which compensates for unwanted feedback under the assumption that the transfer behavior of the feedback remains constant for a longer time. In this case, only signal path 5, 6, 7, 8, 1, 2 was included in the measurement and the resulting impulse response represents directly the desired impulse response of filter 9 except for the reversed sign. But another approach is possible in which the two feedback paths, both external feedback and also internal compensating feedback, are taken into account at the same time. This case is shown in FIG. 6. Here, a digital pulse is supplied to the signal path via summation element 12 such that both D/A converter 5 and also FIR filter 9 are triggered thereby. Now at the output of summation element 3, the impulse response of the parallel connection of two signal paths 5, 6, 7, 8, 1, 2 and 9 is observed.

For ideal compensation of the external feedback by filter 9 at the output of element 3, no impulse response should be observed. However, compensation can deviate from ideal for two reasons. First, in determination of the impulse responses $h_k$, finite errors necessarily occur, and second, signal path 5, 6, 7, 8, 1, 2 can change over time, so that an initially complete compensation is no longer complete after a certain time. For nonideal compensation, in the absence of external signals at the output of summation unit 3, nonzero samples occur which should be labelled $h_0''$, $h_1''$, $h_2''$ . . . To compensate them as well, according to the aforementioned considerations, parallel to signal paths 5, 6, 7, 8, 1, 2, and 9 there would have to be another signal path with output samples which would have to satisfy the equation:

$$r''_n = -\sum_{k=0}^{\infty} a_{(n-k)} h''_k$$

If it is assumed that, in this sum, the terms with k>N can be ignored, then this additional signal path could likewise be a FIR filter with the coefficients $c_k = -h_k''$. Two parallel FIR filters with an output which is summed can, however, be replaced by a single filter according to the following equation:

$$r'_n + r''_n = \sum_{k=0}^{N} a_{(n-k)} h'_k - \sum_{k=0}^{N} a_{(n-k)} h''_k = \sum_{k=0}^{N} a_{(n-k)} (h'_k - h''_k)$$

We see therefrom that the original filter coefficients $h_k'$ of the FIR filter must be corrected by impulse response $h_k''$ with the reverse sign in order to achieve ideal compensation again.

In the manner of operation according to FIG. 6, interruption of the signal path by switch 13 is not always necessary because it can be assumed that, at the start of measurement, at least partial compensation by filter 9 was achieved using the measurement methods described above. This means that the magnitude of the loop gain at all frequencies is clearly less than 1 and that, therefore, no significant measurement error results due to multiple passage through the signal loop occurs. This fact makes the correcting measurement according to FIG. 6 suitable for subsequent adaptation of a preset filter.

The method given here for determining or adaptively improving the filter coefficients of the compensating FIR filter has the advantage that the only additional measure which must be provided for this purpose in the hearing aid is supplying of a digital pulse at the input of signal path 5, 6, 7, 8, 1, 2. Everything else is obtained from the signal processing structure which is present anyway and the digital system control 15 which is, likewise, present anyway without additional hardware cost.

A computer simulation of the process of the invention was performed. This simulation makes it possible to determine the effect of the following quantities:

- transfer function H(f) or impulse response h(t) of feedback 8
- sampling rate in digital signal processing
- number of coefficients used in the filter
- errors in measurement of the samples If for example a sampling rate of 40 kHz is used, and a 10% random error is computed in the determination of the samples, a sequence of 48 filter coefficients is enough to reduce the maximum amplitude of the feedback signal from the input of the D/A converter to the output of summation unit 3 through compensation by roughly 20 dB. At a sampling rate of 60 kHz, 55 filter coefficients are necessary for this purpose. In the simulated case, the transfer function h(t) of feedback 8 contains no poles of high quality (>10). The entire sequence of filter coefficients used corresponds to an impulse response of 1–1.2 msec duration for the given data. The higher the pole qualities in the feedback transfer function, the longer the required sequence of coefficients.

Compared to the adaptation process given in EP-A-0 415 677 by correlation with supplied noise, the determination of the filter coefficient of this invention has the advantage of simplicity.

Conversely, it could be considered a disadvantage that the filter coefficient measurement process which in a one-time measurement should be done for reasons of measurement accuracy with a relatively large amplitude of the supplied pulse, for the user of the hearing aid, represents an audible click of roughly 1 msec duration, and that, in addition, no external signal may act at this time.

That the one-time, nonadaptive measurement of the filter coefficient presupposes the constancy of signal path 5, 6, 7, 8, 1, 2 could also be considered another disadvantage.

The latter disadvantage is important mainly for conventional hearing aids. However, if this process is applied to a fully or partially implanted hearing aid, constant feedback conditions can be expected over a longer time. In this case, signal path 5, 6, 7, 8, 1, 2 changes mainly when the user, via his control device, changes the gain or another parameter which influences signal path 5, 6, 7, 8, 1, 2. In this case, it is not only reasonable, but under certain circumstances even desirable that the hearing aid "acknowledges" the command of the control device with an audible signal. Therefore here the audibility of the measurement process would not be disturbing.

The disadvantage that, at the time of measurement, there should be no external acoustic signal in order to prevent measurement errors is not a "strict" requirement. For a one-time measurement, it is enough that a strong signal does not arrive from the outside.

However, this requirement can be further attenuated by taking a large number of measurements instead of a single measurement, and averaging the results. Since external signals are not correlated with the supplied pulses, their effect when averaging is canceled over a sufficiently large number of measurements. Because the impulse response has decayed within 2 msec to such an extent that a new measurement can be taken, for example, a hundred measurements can be taken in a fraction of a second, and in this way, the error caused by external acoustic signals can be largely suppressed.

The fact remains that this repeated measurement remains audible to the user with a host of short click pulses. A larger number of measurements in the same time interval would be perceived as a tone with the repetition frequency of the measurements. Under certain circumstances, it is more pleasant for the user if the measurements are taken in a time interval which is controlled quasi-randomly, because then repeated measurements are not perceived as a tone, but as noise.

It only makes sense to calibrate the FIR filter in larger time intervals when the transfer behavior of feedback signal path 5, 6, 7, 8, 1, 2 remains roughly constant over a longer time. Nevertheless, if feedback should change to a degree which leads to instabilities of the hearing aid, it is furthermore possible that system control 15 monitors the hearing aid at regular time intervals for the occurrence of individual sinusoidal signals which exceed a given amplitude and/or exceed the remaining frequency spectrum by a certain level. Occurrence of such sinusoidal signals is an indication of instability by feedback and can be established by the digital Fourier transform (DFT) of the digital signals. If such a signal is detected, it is possible to have the hearing aid re-measure the filter coefficients autonomously.

The measurement process as shown in FIG. 6 is especially suited for continuous adaptation of compensation to the changing feedback paths. This is of interest especially in conventional hearing aids in which a more frequent change of signal path 5, 6, 7, 8, 1, 2 can be expected. But also in implanted hearing aids, under certain circumstances, slowly changing feedback paths can be continuously tracked. Here, the following strategy can be applied: after initial calibration of the feedback filter in the aforementioned manner, continuous adaptation of the feedback filter according to the manner of operation described above in conjunction with FIG. 6 follows by a measurement process being triggered at certain time intervals, for example, 10 times a second, which however is carried out with a pulse amplitude which is chosen to be so small that it is not perceived by the user at all, or at least not perceived as disturbing. The magnitude of this pulse amplitude can be controlled depending on the external acoustic signal. The result of each individual measurement, in this case, is regularly disturbed by external acoustic signals. However, if the results are used to update the filter coefficients with correspondingly little weighting, the effect of the external acoustic signal which is not correlated with the measurements drops from the host of measurements.

While various embodiments in accordance with the present invention have been shown and described, it is understood that the invention is not limited thereto, and is susceptible to numerous changes and modifications as known to those skilled in the art. For example, while a microphone 1 has been described above, such is only one form of suitable electromechanical transducer, and those skilled in the art will recognize that any device capable of converting mechanical vibrations into electrical signals can be used. Therefore, this invention is not limited to the details shown and described herein, and includes all such changes and modifications as are encompassed by the scope of the appended claims.

We claim:

1. Hearing aid having a main signal path comprised in succession of an electromechanical transducer, an A/D converter for conversion of an output signal from the electromechanical transducer into a sequence of discrete digital samples, a signal processing stage, a D/A converter for converting processed digital signals from the signal processing stage back into analog form, an amplifier and an output converter, and which is provided with a feedback signal path within the hearing aid, in which a digital filter with a finite impulse response is located, and which has a transfer function which is settable by stipulating corresponding filter coefficients, and a determination and setting circuit which determines the transfer function of the feedback signal path via which unwanted acoustic and/or mechanical feedback takes place between the output converter and the electromechanical transducer and which, depending on the determined transfer function of feedback signal path, adjusts the filter coefficient of the filter in the feedback path within the hearing aid in a manner at least partially compensating the acoustic and/or mechanical feedback;

wherein the determination and setting circuit has a pulse generator for feeding short individual pulses to the feedback signal path and for measuring the transfer function of the path using an impulse response of the feedback signal path triggered by the individual pulses, the duration of the individual pulses being at most equal to 1/f, where f is the sampling frequency of the A/D converter and the D/A converter.

2. Hearing aid as claimed in claim 1, wherein the pulse generator is a digital pulse generator and is connected to the input of the D/A converter via a summation element for digitally feeding the individual pulses thereto.

3. Hearing aid as claimed in claim 1, wherein the pulse generator is an analog pulse generator and is connected to the input of the amplifier for feeding the individual pulses thereto in analog form.

4. Hearing aid as claimed in claim 2, wherein the digital pulse generator is also connected via the summation element to the input of the filter in the feedback path within the hearing aid for determination of the impulse response of the feedback signal path within the hearing aid and a feedback path parallel to it for adaptive optimization of the filter coefficient of filter which is located in the feedback path within the hearing aid.

5. Hearing aid as claimed in claim 1, wherein the signal processing stage has a digital filter which processes digital samples delivered from the A/D converter depending on the hearing damage of the particular intended wearer of the hearing aid, and which is connected on an input side thereof to the output of the digital filter in the feedback path and on an output side thereof to an input of the digital filter in the feedback path within the hearing aid.

6. Hearing aid as claimed in claim 1, wherein the D/A converter and the amplifier are combined in an integral unit.

7. Hearing aid as claimed in claim 1, wherein the determination and setting circuit comprises means for providing a sequence of n filter coefficients for the filter which is located in the feedback path within the hearing aid, which are, except for a common constant factor, equal to the first n digital samples of the reaction of feedback signal path to the individual pulses when an external acoustic signal is absent and when the signal path is temporarily blocked by the signal processing stage.

8. Hearing aid as claimed in claim 1, wherein the determination and setting circuit comprises means for providing a sequence of n filter coefficients for the filter which is located in the feedback path within the hearing aid which are, except for a common constant factor, equal to a value, which has been averaged from several measurements, of the first n digital samples of the reaction of feedback signal path to the individual pulses when an external acoustic signal is absent and when the signal path is temporarily blocked by the signal processing stage.

9. Hearing aid as claimed in claim 8, wherein the determination and setting circuit is operable for performing the several measurements in quasi-random time intervals.

10. Hearing aid as claimed in claim 1, wherein the determination and setting circuit comprises means for providing a sequence of n filter coefficients for the filter which is located in the feedback path within the hearing aid which are, except for a common constant factor, equal to the value, which has been averaged from several measurements, of the first n digital samples of the reaction of feedback signal path to the coupled brief pulse when an external acoustic signal is present.

11. Hearing aid as claimed in claim 10, wherein the determination and setting circuit is operable for performing the several measurements in quasi-random time intervals.

12. Hearing aid as claimed in claim 4, wherein the determination and setting circuit comprises means for providing a sequence of n filter coefficients for the filter which is located in the feedback path within the hearing aid which is adaptively improved by addition of the first n samples of the reaction of the parallel connection of two feedback signal paths to the individual pulses supplied to the two feedback signal paths, the samples being, multiplied by a common constant factor.

13. Hearing aid as claimed in claim 12, wherein the determination and setting, circuit comprises means for temporarily blocking the signal paths prior to the providing of said sequence of n filter coefficients and for choosing the sequence of n filter coefficients of the filter of the reaction of the feedback signal path to be equal to the first n digital samples of the reaction of the feedback signal path to the individual pulses, except for a common constant factor.

14. Hearing aid as claimed in claim 12, wherein the determination and setting, circuit comprises means for performing measurements for adaptive improvement of the filter coefficients of the filter which is located in the feedback path within the hearing aid and updating of the filter coefficients at regular time intervals.

15. Hearing aid as claimed in claim 12, wherein the determination and setting, circuit means for performing measurements for adaptive improvement of the filter coefficients of the filter which is located in the feedback path within the hearing aid and updating of the filter coefficients at quasi-random time intervals.

16. Hearing aid as claimed in claim 12, wherein digital pulse generator supplies pulses having a digital amplitude low enough to be insignificantly perceptible by a wearer of the hearing aid.

17. Hearing aid as claimed in claim 12, wherein determination and setting circuit comprises means for adjusting the digital amplitude of the pulses supplied by the digital pulse generator depending on the level of the instantaneous external acoustic signal in a manner setting the digital amplitude low enough to be insignificantly perceptible by a wearer of the hearing aid.

18. Hearing aid as claimed in claim 12, wherein the determination and setting circuit comprises means for triggering re-measurement of the filter coefficient each time the hearing aid is turned on or any audiological signal processing feature is changed by the user.

19. Hearing aid as claimed in claim 12, wherein the determination and setting circuit has means for monitoring the signal on the main signal path for the occurrence of individual sine lines with an amplitude which exceeds a remaining frequency spectrum of the signal on the main signal path by a given amount and for triggering re-measurement of the filter coefficients upon occurrence of this sine signal triggers.

* * * * *